United States Patent [19]

Kai

[11] 4,247,007

[45] Jan. 27, 1981

[54] STRANDS AND NETTING AND SCREENS MADE THEREOF

[76] Inventor: Yuriko Kai, 16-13, Hakataekiminami Hakataku, Fukuokashi, Fukuokaken, Japan

[21] Appl. No.: 957,321

[22] Filed: Nov. 2, 1978

Related U.S. Application Data

[63] Continuation of Ser. No. 719,396, Sep. 1, 1976, abandoned.

[51] Int. Cl.[3] ..... B07B 1/46

[52] U.S. Cl. ..... 209/392; 209/400

[58] Field of Search ..... 209/401, 400, 394, 392, 209/405, 408, 403; 428/113; 210/499; 264/DIG. 70

[56] References Cited

U.S. PATENT DOCUMENTS

| | | | |
|---|---|---|---|
| 31,981 | 4/1861 | Hunter | 209/313 |
| 2,016,972 | 10/1935 | Schieferstein | 209/403 |
| 2,274,700 | 3/1942 | Jenks | 209/401 |
| 2,723,032 | 11/1955 | Gisler | 209/401 |

FOREIGN PATENT DOCUMENTS

| | | | |
|---|---|---|---|
| 650690 | 9/1938 | Fed. Rep. of Germany | 209/401 |
| 1151430 | 7/1963 | Fed. Rep. of Germany | 209/401 |
| 2268906 | 1/1973 | Fed. Rep. of Germany | 210/499 |
| 802044 | 10/1936 | France | 209/400 |
| 40-20973 | 6/1965 | Japan | 427/243 |
| 1336594 | 11/1973 | United Kingdom | 209/401 |

*Primary Examiner*—Robert Halper

*Attorney, Agent, or Firm*—Koda and Androlia

[57] ABSTRACT

A net or screen formed of crossing strands of an abrasion-resisting organic element and a sieve constructed with such netting or screening. The strands may be either cored or coreless. Where a core is provided it may consist of some type of metallic wire, inorganic fibre or organic polimerized elongationless strands, either solid or formed of monofilament or twisted strands. The net or screen is formed by arranging one set of strands in a plane parallel to each other and spaced apart by predetermined distances and placing a second set of strands, spaced at the same or other predetermined distances parallel to each other, transverse to and on the first set of strands. The two sets of strands are caused to adhere to predetermined points of contact by heating to a temperature at which the contacting elastomers fuse to each other. Netting or screening so formed may be employed to construct screening, such as may be employed in sieves, particularly for sifting out finer materials from coarser materials. Such sieve construction may be accomplished by inserting the ends of one set of strands of the netting in clamping plates and drawing said plates apart from each other by tightening them against walls spaced from each other.

1 Claim, 49 Drawing Figures

STRANDS AND NETTING AND SCREENS MADE THEREOF

This is a continuation of application Ser. No. 719,396 filed Sept. 1, 1976 now abandoned.

BACKGROUND OF THE INVENTION

1. Field of The Invention

This invention relates generally to the manufacture of netting or screening mesh and particularly to screening which is intended to be incorporated in apparatus or devices designed to accomplish sifting out finer materials which are intermingled with coarser materials, as for example, ores.

2. Description of The Prior Art

Prior art screening which has been particularly constructed for sifting apparatus and other uses in industry has generally been formed of interlaced or woven metallic strands. When used to sift certain materials, such as ore or other hard substances, as such materials are passed across a prior art screened area, the noise produced may be objectionably loud. Such objectionable noise can be produced either by the material bouncing across the metallic strands of the screen, or by such material causing the contacting wire strands to rub against each other.

Another objection to metal screening of the prior art is that the metallic wires can abrade the material being passed over the screening where, in some instances, such abrasion may not be desired. If the material being sifted is very hard, however, the metal screening itself may become abraded. In addition, such prior art metal screening may required a considerable amount of time on the part of service personnel to mount, remove or repair the metallic screening in sifting apparatus installations. Further, such screening can become plugged or deformed with respect to the materials being screened, thereby adversely affecting the efficiency of the sifting process by, for example, permitting an undersized piece of ore to be retained on the screen or permitting an oversized piece of ore to pass through the screen where deformation has occurred. In addition, it is well known that prior art metal screening does not ordinarily last for a long period of time when it is subjected to intensive use in a sifting process, being subject to rust or other deterioration, not only through such use, but even when placed in storage. Lastly, metallic screening is ordinarilly heavy and necessarily adds greatly to the weight of sifting frames or mountings so that it may be inconvenient to handle.

SUMMARY OF THE INVENTION

The present invention seeks to obviate the problem engendered by metallic screening utilized in prior art sifting apparatus as hereinabove described. According to the present invention, the screening is constructed of abrasion-resisting organic elastomer strands. Such strands may be either extruded filaments, strings, rods or bars of such an elastomer, including natural rubber, synthetic rubber, synthetic polymer or other related compounds which are abrasion-resisting, but thermal plastic or thermo setting. One example of such a polymer might be a thermo-plastic urethane elastomer. Alternatively, the strand could comprise a metal filament or wire, either solid or twisted, with another meal filament or wire, or with a filament of such an elastomer, or a rod or bar, coated with such an elastomer.

Prior art screened, the noise produced may be objectionably loud. Such objectionable noise can be produced either by the material bouncing across the metallic strands of the screen, or by such material causing the contacting wire strands to rub against each other.

Another objection to metal screening of the prior art is that the metallic wires can abrade the material being passed over the screening where, in some instances, such abrasion may not be desired. If the material being sifted is very hard, however, the metal screening itself may become abraded. In addition, such prior art metal screening may required a considerable amount of time on the part of service personnel to mount, remove or repair the metallic screening in sifting apparatus installations. Further, such screening can become plugged or deformed with respect to the materials being screened, thereby adversely affecting the efficiency of the sifting process by, for example, permitting an undersized piece of ore to be retained on the screen or permitting an oversized piece of ore to pass through the screen where deformation has occured. In addition, it is well known that prior art metal screening does not ordinarily last for a long period of time when it is subjected to intensive use in a sifting process, being subject to rust or other deterioration, not only through such use, but even when placed in storage. Lastly, metallic screening is ordinarily heavy and necessarily adds greatly to the weight of sifting frames or mountings so that it may be inconvenient to handle.

The net of the present invention includes a first layer of transverse strands being laid in a plane, a second layer of longitudinal strands being laid upon said first layer of said transverse strands so as to be in a plane, said transverse strands, each of said strands comprising an elongated element having at least its outer surface constituted of an abrasion-resisting organic elastomer, predetermined intervals, and fastened, with tension, rigidly to the net supporting side plate members, the outer surface portion of said transverse strands being constituted at least of the abrasion-resistant organic elastomer, said two layers comprising said longitudinal strands being laid parallel to the direction of progression of said object to be processed at predetermined equal intervals and fastened rigidly to the supporting body with tension, the outer surface at least of said longitudinal strands being constituted of the abrasion-resisting organic elastomer at least at its outer exposed surface contacting object to be screened.

said strands being disposed orthogonally to the direction of progression of said objects to be processed, being laid parallel to each other and spaced by a first predetermined interval distance from, and rigidly fixed with tension to the side plate body for supporting the net, said second layer of similar strands, said second layer of strands being constituted of said longitudinal strands being the same or larger than the thickness of said elastomer of said transverse strands, said second layer of strands being laid upon the strands of the said first layer to contact the latter strands at crossing points therewith orthogonally to the first layer, each of the strands in said second layer being laid parallel to, and spaced by a second predetermined distance from each other, a second layer having at least its outer exposed surface constituted of an abrasion-resisting organic elastomer, being spaced by a first predetermined distance from each other in a plane:

the said elastomer surface of the strands of both layers being fused together at said predetermined crossing points by said contacting strands, including said fused together points are naught points and may have no such fused surface at all:

Mesh openings as described are that the length of two opposing sides constituting one pair of each net mesh layer strands is longer than the length of two opposing sides constituting the other pair and that the mesh opening area is greater than the apparent opening area, such as illustrated area in the plan view of drawings, as seen from the above among other features of the net are the following:

In order to the surfaces of the strands are provided with a surface fusion layer whose thickness, less than the thickness of the elastomer, is equivalent to 15~40 percent of the diameter of said strands.

The thickness of the elastomer as described of the said upper strands is equal to one through three times the thickness of that of the lower layer strands.

The upper layer strands as described are adapted for guiding the object to be processed in the direction in which it is progressed.

A case, wherein there arises the need for producing no fusion points at the crossing surfaces locations of both layer strands, the net will be provided with abrasion-resisting organic elastomer covered strands, disposed parallel to the longitudinal direction and in the same plane as the upper layer strands, in such a manner that they are laid independent from each other and penetrate through the transverse elastomer strands forming the lower layer instead of the fusion.

Strands, both upper and lower strands may have core strands or no core strands, made of the core strands of the said cored strands consisting of either metallic wires, elongationless organic polymer strands or inorganic fibre strands.

In the special case of a netting or screening having large openings, the mesh may be constructed with metal strands having large cross sections with the surface of each metal strand being covered with an abrasion-resisting organic elastomer. In such an embodiment of the invention, the metallic strands may be arranged with equal spacings as predetermined to partially define the required size of mesh openings in the transverse direction of the screen and the longitudinal strands are arranged over them perpendicular to the transversely extending metal strands with equal spacings as predetermined to complete the definition of the required size of mesh openings. A metallic net constructed in this way is thus covered on its entire surface with an abrasion-resisting organic elastomer. The elastomer contacting points of the coverings may then be heated to fuse or melt together the thus contacting organic elastomer points. Where such coverings are provided they should be sufficiently thick to insure durability in accordance with the shaping of the openings.

In addition to arranging the strands to provide square or rectangular openings in the manner hereinabove explained, the net may be reinforced by placing metallic strands of smaller cross section than the cross sections of the strands utilized to form the netting or screening, but having an abrasion-resisting covering of an organic elastomer or strands of such an elastomer, at each of one or more corners of each opening, thereby to define small triangles in the netting.

During the sifting operation, the strands around the approximate square openings and other sizes of the net are vibrated and the strands in the upper layer guide the progress of the object being sifted.

Moreover, the longitudinally extending strands in the upper layer may serve to guide the progress of the material to be screened, thereby further improving the efficiency in sifting. The longitudinal strands may be arranged at equal intervals, which are two or several times the equal interval distance of the transverse strands, and the transverse strands may be fixed to each other by holding and melting in order to maintain their locations at or off the center portion of cored longitudinal strands when the latter strands may be employed. Such longitudinal strands may have a circular or polygonal cross section of a large sectional area in order to insure sufficient durability to the transverse strands, when made of an abrasion-resisting organic elastomer, and may be arranged to keep the space ratio of the net, forming the opening of each other rectangular shape. During screening those strands located around the mesh of a square or an approximately square and the strands made of abrasion-resisting organic elastomer are caused to vibrate and the strands in upper layer guide and help the movement of the object to be screened.

When utilized for sifting ore, the ore pebbles which may arrive at the opening part of the net, will snap back through the vibration of the net itself or will fall through the openings because of the spring of the strands, thereby avoiding blocking of the net openings. Thus, the purpose of the screening is attained with high efficiency. Eventually, the upper strands of the net cause the advance of particles to be concentrated and operate to promote the efficiency of the riddle, rapidly in the longitudinal direction to make screening accurate, and in that the occurrence of sound waves at frequencies hazardous to the human body, being minimized and the life span of net be able to sufficiently be extended. As the transverse strands may be constituted of strands with cores, and as such be rigid, they do not loosen. Even if the strands without cores are used, by employing urethane elastomers having small percent elongations, the same kind of effect may be attained because of their high abrasion-resisting characteristics—even superior to piano wires—and its non-loosening property.

It will be readily appreciated by those persons skilled in the art that a screen constructed in accordance with the present invention, particularly when employed in a sifting device or apparatus, offers many advantages over prior art screens in that, when sifting of material occurs, the noise level is significantly reduced; resistance to abrasion is improved both in respect of the material being sifted as well as in respect of the surfaces of the strands which are contacted by such material; rusting is eliminated so that the screen should not deteriorate over a long period of time of its use and/or storage; the screen construction is readily adaptable for mass production; and its mounting, removal, maintenance and repair is greatly facilitated so as to require a minimum of time and labor. In addition, because of the resilience of the elastomer of the strands or their coatings, vibration of the sifting screen better enables particles of the proper screen size to pass through the screen openings and not to become clogged in the mesh, as is so frequently the case with prior art metal screening. Thus, the screening of the present invention offers many advantages over metallic screening of the prior art.

According to the present invention, in order to maintain the tension of the net or screen in the transverse direction, each end of the transverse strands may be secured by a metal fitting, such as solderless terminal or a fitting having one end to receive a strand and the other resembling a link fuse. A nut having an inside screw thread is tightened between the upper clamping plate and the lower clamping plate and is secured, for example, by means of a bolt, nut or rivet. Such tightening means also constitutes a feature of the present invention. Thus, the inner edge of the lower clamping plate is bent down toward the center of the screen at a gentle slope. Thereby, the lower surfaces towards the ends of the organic elastomer strands are prevented from being sheared by the inwardly protruding edge of the lower clamping plate when the screen net is set up and vibrated as the material being screened is passed thereover. Moreover, when the screen net is clamped and tightened between the upper clamping plate and the lower clamping plate and secured, for example, with a bolt and nut, a sheet or covering of a suitable strip of abrasion resisting organic elastomer may be secured on the upper surface of the upper clamping plate by fusion or some other suitable method.

DESCRIPTION OF THE PREFERRED EMBODIMENT

Figure 1A:
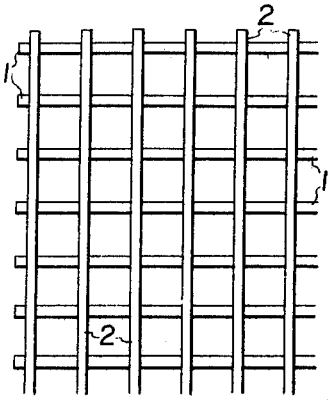
FIGS. 1A and 1B are a plan view and a side view, respectively, of a first embodiment of the present invention, in which the shape of each opening in the net or screen is substantially square, and net strands are made of an abrasion-resisting organic elastomer.
Figure 1B:
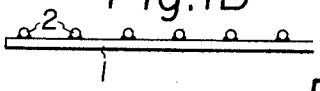

Referring to FIGS. 1A and 1B of the accompanying drawings, a screen or net constructed in accordance with the present invention may comprise a plurality of equidistantly spaced parallel, horizontal strands 1 laid in a common plane to constitute one layer over which is laid a second layer of equidistantly spaced parallel, vertical strands 2. As used in this specification, the word "strand" includes not only thin, elongated elements such as solid or twisted metallic wires, filaments, twisted chemical or naturally spun fibers and metallic rods or bars of small cross section or diameter, but also includes elongated, thin elements of rubber, elastomer and any metallic or other thin elongated element which is mixed or coated with any of such elastomers; or thin, elongated elements thereof and strips of any of such elements or elastomers. In this connection the term "abrasion-resisting elastomer" should be deemed to include without limitation, natural rubber, synthetic rubber, chemical polymerizing materials as, for example, isoprene, neoprene, and a product which is sold under the trademark "S.B.R.", and polyurethane elastomers, which have abrasion-resisting properties.

After the layer of strands 2 has been laid over the layer of strands 1, as shown in FIGS. 1A and 1B, the two layers are subjected to sufficient heating to cause all points of contact of the strands 2 with the strands 1 to melt or fuse. As a result of the commencement of melting and fusing of the elastomer content or coating of the two strands, when the strands cool, the crossing strands will become fixed relative to each other to form a net or screen in the pattern in which they have been thus laid.

In the embodiments of the invention shown in FIGS. 2A, 2B, 3A and 3B, fewer and more widely spaced strands are provided than in the embodiment of FIGS. 1A and 1B, with the result that in the case of the embodiments of FIGS. 2A, 2B, 3A and 3B, the interstitial openings or mesh defined by the crossing strands 1 and 2 will be observed to be long rectangles and not squares, as in the FIGS. 1A and 1B embodiment. It is a feature of the present invention that the exact structure of the mesh of the screen may be preselected with reference to the relative importance between the accuracy and efficiency of the screening.

Figure 7B:
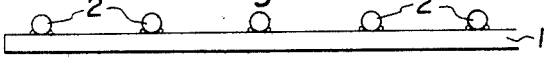
FIGS. 7A, 7B and 7C are a plan view, and two side elevations, respectively, of an embodiment of this invention in which its transverse strands are cored.
Figure 7A:
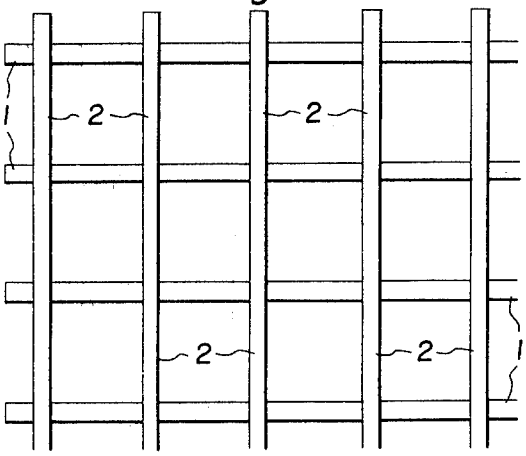
Figure 7C:
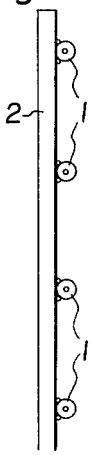
Figure 9:
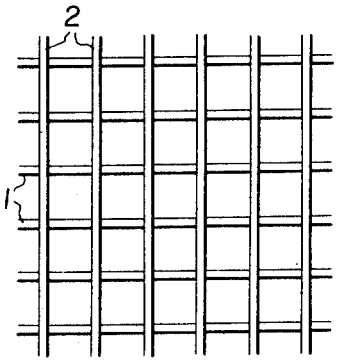
FIG. 9 is a plan view of another embodiment of the present invention.

Referring to the embodiment of the invention illustrated in FIGS. 7A, 7B and 7C, the transverse strands 1 may be made of an abrasion-resisting organic elastomer, such as a urethane elastomer or an abrasion-resisting rubber, and are disposed to constitute the bottom layer of the net or screen. Over this bottom layer, a layer of strands 2 may then be laid to cross strains 1 at right angles. The spacing between the strands of each of the layers is such as to define the required size of mesh openings, and the two layers of strands are secured together by heating to cause them to fuse at their contact or crossing points in the manner previously described.

Figure 8:
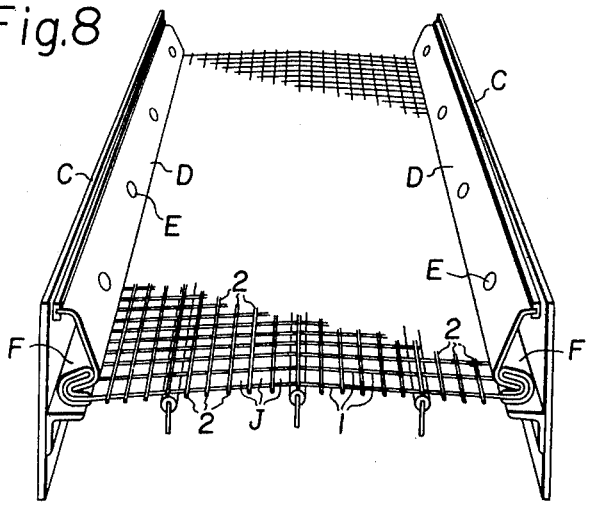
FIG. 8 is a perspective view of a sieve in which the net or screen shown in FIGS. 7A, 7B and 7C has been installed.
Figure 11A:
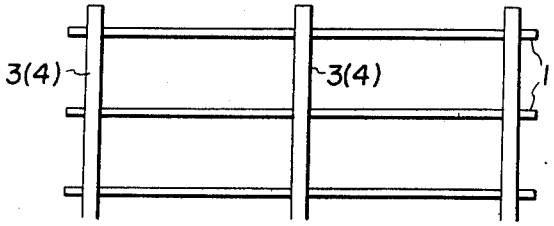
FIGS. 11A and 11B are a plan view and a side view, respectively, of another embodiment of the present invention.
Figure 10:
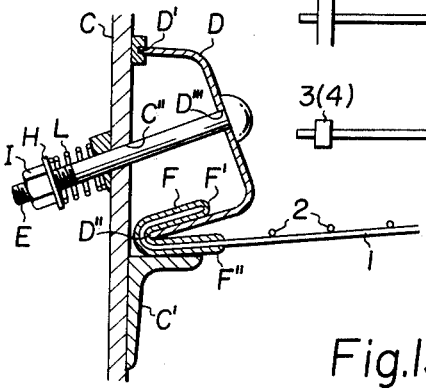
FIG. 10 is an enlarged and cross sectional view of a portion of the sieve shown in FIG. 8, illustrating the means to anchor the net or screen.

The net or screen thus constructed may be incorporated in an automatic vibrating sieve device of the type shown in FIGS. 8 and 10. Such incorporation may be accomplished by inserting the ends of the strands 1 in the metal fittings F disposed on the shelf C′ secured to the wall C which constitutes the side framing of the sieve. A metal channel D is provided with one edge D′ seated on the inside of the wall C, and its other D″ inserted between the two wings F′, F″ of the metal fitting F. A screw E is then passed through an orifice D‴ in the channel D and through another orifice C″ in the wall C. By virtue of the arrangement of the spring G, washer H and nut 1 shown in FIG. 10, it may be seen that the channel D may be drawn toward the wall C by tightening of the nut I on the screw E. Thereby, the transverse strands 1 may be brought into tension from both of their ends, while the longitudinal strands 2 will be unaffected by such tensioning.

It will be recognized by those persons skilled in the art that FIG. 8 discloses generally a type of screen adapted for use in an automatic vibrating sieve to accomplish the sifting of material such as, for example, crushed ore. In such a screen, the crushed ore particles or pebbles (not shown) are rolled downwardly along the screen mostly between the strands 2 and over the strands 1. As such rolling occurs, the pebbles or particles which are smaller than the interstitial mesh openings will drop through such openings and onto some conveyor or other surface (not shown), while the particles which are larger than such openings will continue to roll down to the end of the screening to be deposited in another area or receptacle (also not shown). Thereby, the two different sizes of particles or pebbles may be sorted out. Since size difference may mean a difference in mineral content, screens constructed in accordance with the present invention may greatly improve the desired sorting out of the different size pebbles in the course of an ore concentrating process. Because of the resiliency of the abrasion-resisting organic elastomer strands of which the screening is constructed in accordance with the present invention, ore pebbles of a size which might be stopped in but not pass through openings in a prior art metal wire screen will be caused either to fall through the openings, if they are small enough in size, or to be bounced out of the mesh openings so as not to block the same. Thus an ore sieve constructed of screening in accordance with the present invention may attain a high degree of efficiency. Further contributing to such efficiency is the placement of the strands 2 along the lines of travel of the pebbles. By so disposing the strands 2, a plurality of channels are effectively created along which the ore pebbles may be more rapidly moved during the sifting process. Because the transverse strands are tensioned to a rigid state, such strands provide a minimum of impediment to the ore pebbles or particles as they move down between the longitudinal strands 2. Even should the transverse strands be coreless, if a urethane elastomer having a small percent of elongation, when tensioned, is employed, such coreless strands will still be effective because of their high abrasion-resisting capacity, as compared with strands of the type used for piano wire.

The net used is that shown in FIG. 1A, 1B and comprising two kinds with different meshes. The strands are made of urethane elastomer. After 60 any's use as the screen with flowing water, in case of the wire with 10 mm diameter, 0.2 mm was damaged, and in case of the wire with 8 mm diameter, 0.2 mm was damaged likewise. This result shows that the product according to this invention has higher durability than conventional steel one. Furthermore, blocking of the openings substantially didn't occur. They could be repaired, maintained and stocked easily.

The results of the comparison of abrasion-resisting ability or other physical properties between the net according to the present invention and conventional ones are shown in Table 1. As one understands looking at this table, it is superior to any conventional one.

TABLE 1

The result of comparison between the strands according to this invention and conventional one.

| Item | Measured under the condition defined by | Dimension | Strand according this invention: Urethane elastomer | Strand according this invention: Abrasion-resisting rubber | Conventional strand: Brass | Conventional strand: Steel | Conventional strand: Wire used for piano | Remarks |
|---|---|---|---|---|---|---|---|---|
| Hardness | Japanese Industrial Standard (J.I.S.) K-6301 | Shore hardness degree | 85** | 80** | HS 24* | HS 32* | HS 55* | |
| Tensile strength | J.I.S. K-6301 | $kg/cm^2$ | 400** | 180** | 35* $kg/mm^2$ | 60* $kg/mm^2$ | 110* $kg/mm^2$ | |
| Percentage elongation | J.I.S. K-6301 | % | 600** | 550** | — | — | — | |

TABLE 1-continued

| The result of comparison between the strands according to this invention and conventional one. | | | | | | | | |
|---|---|---|---|---|---|---|---|---|
| | | | Strand according this invention | | Conventional strand | | | |
| Item | Measured under the condition defined by | Dimension | Urethane elastomer | Abrasion-resisting rubber | Brass | Steel | Wire used for piano | Remarks |
| Resistance to tear off | J.I.S. K-6301 | kg/cm$^2$ | 80** | 40** | — | — | — | |
| Thickness abrassived | Thickness abrassived for sand brast | ratio | 1.0 | 4.0 | 15.0 | 7.02 | — | in case that the rate of abrassive of urethane elastomer regard as 1 |
| Thickness abrassived in sand | Thickness abrassived | ratio | 1.0 | 12.0 | — | 16.3 | 4.0 | in case that the rate of abrassive of urethane elastomer regard as 1 |

Note: In the table.
*Hardness of metals is based on Japanese Industrial Standard (J.I.S.) Z-2246, and tensile strength of metals is based on J.I.S. Z-2241.
**Hardness tensile strength, percentage elongation and resistance to tear off of this invented strands is based on J.I.S. K-6301.

Table 2

As easily understood from this, the aperture area of the net according to this invention is larger than that of a knitted screen, and the same as that of metal screen.

The aperture area by percentage of the nets according to this invention and conventional net.

| | | (an example) aperture area by percentage (space ratio) | | |
|---|---|---|---|---|
| Diameter cross-section | Strand interval | Screen according to this invention (cored strand) | Metal screen | Nitted rubber screen |
| 2.6 | 5 mm | 43% | 43% | 39% |
| 3 | 10 mm | 49% | 49% | 39% |
| 4 | 15 mm | 62% | 62% | 48% |
| 6 | 25 mm | 65% | 65% | 46% |
| 8 | 30 mm | 64% | 64% | 44% |
| 8 | 35 mm | 66% | 65% | 46% |
| 10 | 40 mm | 64% | 64% | 45% |
| 10 | 50 mm | 67% | 67% | 45% |

Figure 2A:
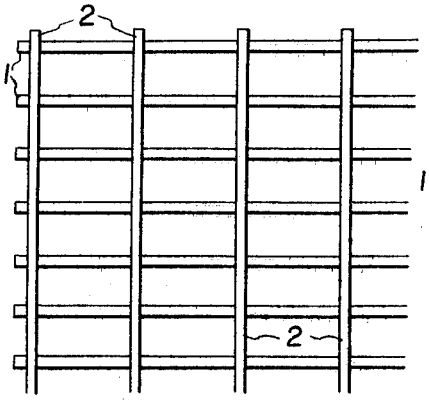
FIGS. 2A and 2B are similar views of another embodiment of the present invention, in which the shape of each opening in the net or screen is a rectangle whose length is twice the width of such opening.
Figure 2B:
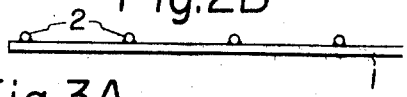
Figure 3A:
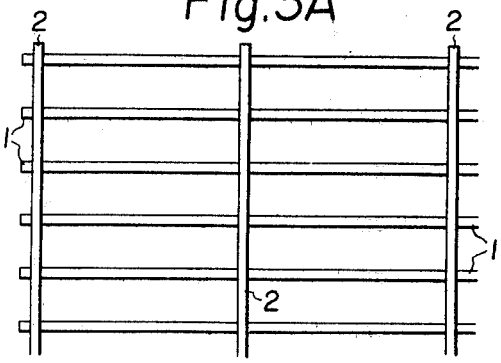
FIGS. 3A and 3B are similar views of still another embodiment of the present invention, in which the shape of each opening in the net or screen is also rectangular, but with its length much greater than its width.
Figure 3B:
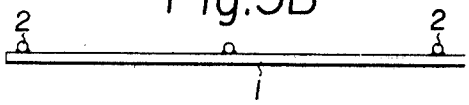
Figure 4:
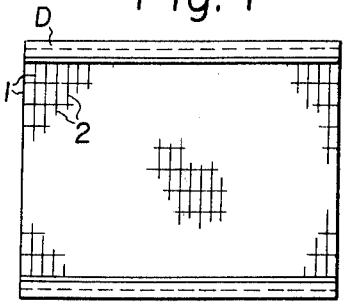
FIG. 4A is a plan view of a net or screen, as shown in FIG. 3, mounted in a sieve.
Figure 5:
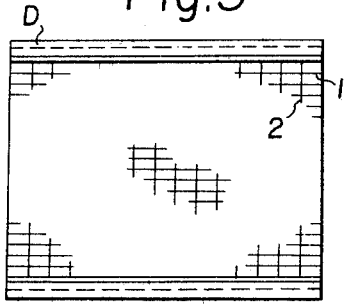
FIG. 5 shows another embodiment of the present invention mounted in a sieve.
Figure 6A:
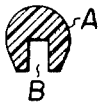
FIGS. 6A through 6I show different cross-sectional configurations of abrasion resisting organic covers for wires.
Figure 6B:
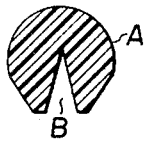
Figure 6C:
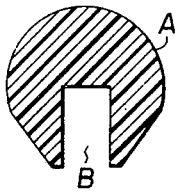
Figure 6D:
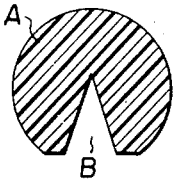
Figure 6E:
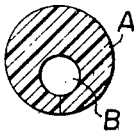
Figure 6F:
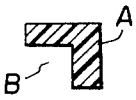
Figure 6G:
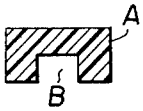
Figure 6H:
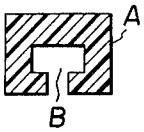
Figure 6I:
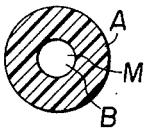

When large aperture area is desired, those structures given in FIG. 2A, 2B and 3 may be chosen. According to this invention, the structure of the net can be chosen as to the priority between accuracy and efficiency of riddle.

Referring to FIG. 6A–6I, some structures for the cushion are shown. The wire of abrasion-resisting elastic organic material is inserted to receiving groove B of the cushion A made of same kind of abrasion-resisting elastic organic material. Then this is welded to form single wire. Or, metal wire, the rope comprising twisted metal wires, monofilament of synthetic resin with small expansibility or its twisted wire rope is put into the receiving groove B and can be used as a strand after welded together. And the shape of the cross section can be form into that as wanted, square shape, for instance. In the embodiments shown in FIG. 1, 2 and 3, they can be used.

Referring to FIG. 7A, 7B, 7C, 8, 9, the present invention can be explained. Here, the wires 1 of transverse lines of thermoplastic urethane elastomer with core same to those given in Table 1 are put in the lower part. And in the upper part, the strands 2 without a core and of the same material are put as longitudinal lines. Both strands cross perpendicularly. Their intervals are roughly the same, or those of longitudinal lines are rather small, so as to form predetermined opening area. The strands of longitudinal and transverse lines are welded together at their cross point. Its plan view corresponds to FIG. 9 and side view, to FIG. 7, respectively. The way the net is mounted to automatic vibrating screen is shown in FIG. 8 and 10. The both ends of strand 1 are inserted in metal fittings F of the frame of the screen, and secured to plate D by screw E, and thereby lower strands are tensioned through both ends, while the upper strands are free. The screen can be used for crushed ore. The crushed ore pebbles roll on the upper strands 2, and those of under size pass through the square mesh formed by both upper and lower strands and fall. On the other hand, those of over size roll on the net further. Thus two kinds of stones is sorted and concentrated. In ore concentrating process, since difference in size means difference in mineral content, screening mentioned above is important step.

Figure 11B:
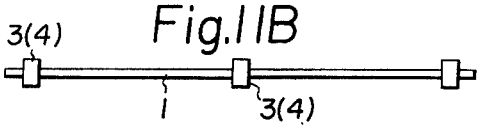
Figure 13A:
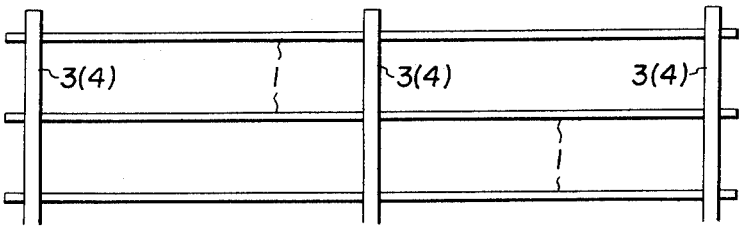
FIGS. 13A and 13B are a plan view and a side view, respectively, of another embodiment of the present invention.
Figure 13B:
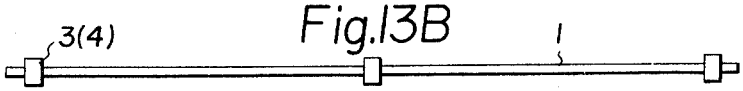

In the embodiment of the invention illustrated in FIGS. 11A, 11B, 13A and 13B, the screening is constructed with mesh openings in the form of long rectangles. In this embodiment of the invention, the strands 1 may be made of a thermo-plastic urethane elastomer and are arranged at equal intervals to provide a predetermined length of openings in the direction of travel of the pebbles along the sieve. The strands 3, which may also be of the same elastomer, may be secured to the transverse strands 1 by heating both sets of strands 1 and 3 to the point where they fuse together in the configuration shown in FIGS. 11B and 13B. After the strands 1 and 3 have been so disposed as illustrated in FIGS. 13A and 13B there may be seen to be formed rectangular mesh openings in which the transverse width is as much as several times that of the longitudinal length, or similar to the mesh configuration shown in FIGS. 2A and 3A. Alternatively, however, the strands disposition could be modified to make the longitudinal rectangle dimension longer than its transverse dimension. While, as also illustrated in FIGS. 11B and 13B, the longitudinal strands 3 are shown to have square cross sections, it will be understood by those skilled in the art that the cross sections of the longitudinal strands may be square, rectangular, polygonal or round. Desirably, the thicknesses (i.e., the cross sectional areas) of both the longitudinal and transverse strands 3,1, respectively, should be such that, with use, they will become worn down at substantially the same rates. Because each of the ore pebbles or particles moves down a sieve, in almost continuous contact with at least a pair of longitudinal strands 2, whereas such pebbles may be bounced over the transverse strands 4, the wear on the longitudinal strands may tend to occur at a faster rate than on the transverse strands. For this reason, it is desirable to provide a greater thickness for the longitudinal strands 2 so that the durability of both the longitudinal and transverse strands will be substantially the same.

In the embodiments of FIGS. 11A, 11B, and 13A and 13B, provision is also made for an upper and lower net. The lower net comprises the transverse strands 1 and the longitudinal strands 3. The upper net comprises the longitudinal strands 2 of the thermo-plastic urethane elastomer and transverse strands or cords 4. The latter cross the strands 3 of the lower net perpendicularly and pass below the strands 3 only at such points of crossing. Both the strands 3 and 4 are secured together by fusing at their crossing points. Strands 2 of the upper net are also arranged to cross perpendicularly strands 1 of the lower net with their spacing being the same or almost the same as those of the transverse line. The parenthesized numerals in FIGS. 11A and 11B denote parts of the upper net. The sifting screen thus structured by the upper and lower nets just described is illustrated in FIGS. 13A and 13B. The longitudinal strands 3 in the lower net and the crossing strands or cords 4, in the upper net may be secured together by heating them to a temperature at which they may fuse at their mutual cross points. However, while the strands 1 of the lower net may cross the strands 2 of the upper net perpendicularly, there will be a small vertical spacing or gap between them. Since, therefore, there is no contact between strands 1 and 2 at their crossing points, such crossing points are not secured by fusing. Thus, by providing or avoiding fused crosspoints of net strands, one may either increase the capacity of the sieve to handle a greater volume or ore particles or pebbles, or effect a more accurate sifting of the ore particles or pebbles. The installation of such a two-layer screen may be accomplished in the same manner as that described above in connection with FIGS. 8 and 10 of the drawings.

Referring to FIG. 13, it may be seen that the net has mesh of an extended long rectangular form. The strands 1 made of thermoplastic urethane elastomer are arrayed in equi-intervals corresponding to predetermined size as transverse lines. The rope 3 comprising thermoplastic urethane elastomer are welded to the transverse wires so as to form rectangular openings similar to those shown in FIGS. 2 and 3, and the longitudinal strands may have square, rectangular or circular cross-sections. However, in FIG. 13 square cross sections are shown. As mentioned above, the cross sectional areas of both longitudinal and transverse strands should be such that they will wear away over approximately the same time period. Thus, for example, the longitudinal strands may have larger cross-sectional areas than the transverse strands to result in some relative durability.

In operation, when crushed ores are placed upon a double layer sifting screen of the type just described, sifting is accomplished through the meshes defined by the strands of both the upper and lower nets or screens. Between the two layers there may be mesh openings thus defined which are both almost square at one level, and in the configurations of long rectangles, at another level. Ore pebbles or particles passing over the screen.

Figure 12:
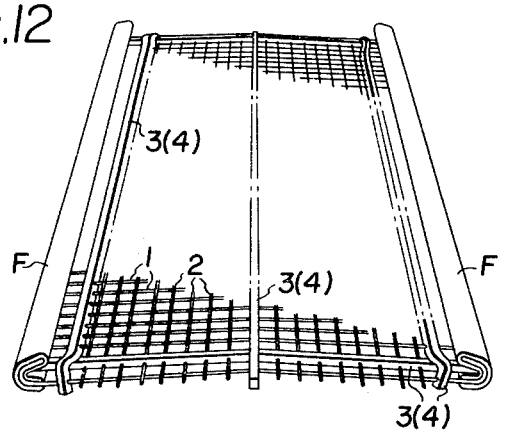
FIG. 12 is a perspective view of a sieve incorporating a net or screen; penetration through the traverse elastomer covered strands instead of fusion.

FIG. 12 is a perspective view of a sieve incorporating a net or screen; penetration through the traverse elastomer covered strands instead of fusion; special longitudinal strands 3(4) are abrasion-resisting elastomer, therefore, do not tend to get caught in the mesh openings to clog up the sifting screen because of both the resiliency of the strands and the particular sizes and configurations of the mesh openings which they define. Ores having a large clay content, therefore, do not tend to clog up the sifting screen.

Figure 16:
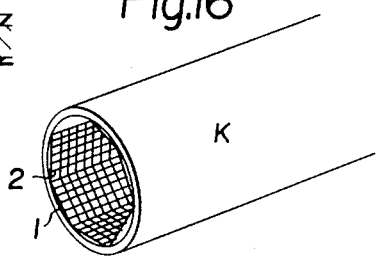
FIG. 16 is a perspective view of a tube or trommel in which is installed a net or screen of the type shown in FIGS. 15A and 15B.

FIG. 16 illustrates the manner in which netting or screening constructed in accordance with the present invention may be employed to line the inside of a tube or trommel K.

Figure 14B:
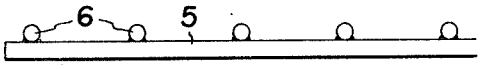
FIGS. 14A, 14B and 14C are a plan view and two side elevations, respectively, of a net constructed with metallic wires which have circular cross sections.
Figure 14A:
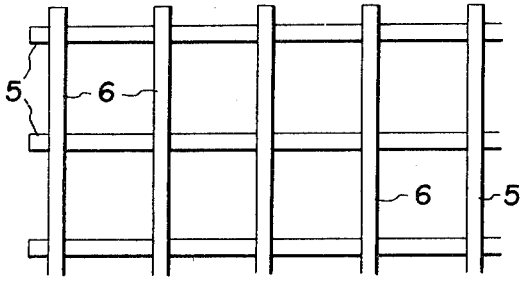
Figure 14C:
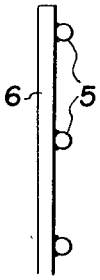

In the embodiment of the invention illustrated in FIGS. 14A, 14B and 14C, the screen or net is constructed of transverse metal wires 5 having circular cross sections and longitudinal metal wires of the same cross sections. The wires 5 and 6 are so spaced and arranged to cross each other and to define square mesh openings, and may be secured to each other at each contact point by welding. While square mesh openings are thus shown and have been selected to handle a particular type of material to be sifted, obviously different types of mesh openings may be defined by rearranging the crossing wires and changing their intervals of spacing. In some instances, if large mesh openings are desired and heavy materials are to be sifted, rods or bars could be substituted for the wires 5 or 6 shown in FIGS. 14A, 14B and 14C.

Figure 15A:
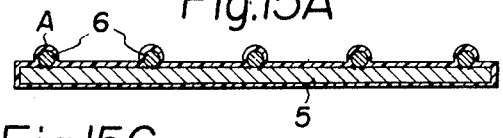
FIGS. 15A and 15B are cross sectional views of a net or screen in which wires illustrated in the FIGS. 14A, 14B and 14C are provided with coverings of an abrasion-resisting organic elastomer.
Figure 15B:
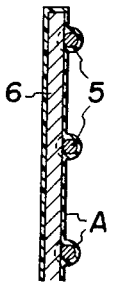
Figure 15C:
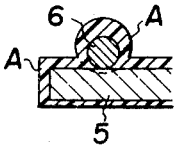
FIG. 15C is an enlarged cross sectional view of a portion of the net or screen shown in FIGS. 15A and 15B.
Figure 17B:
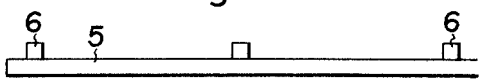
FIGS. 17A and 17B are a plan view and a side view, respectively, of a net or screen constructed with metallic wires which have square cross sections.
Figure 17A:
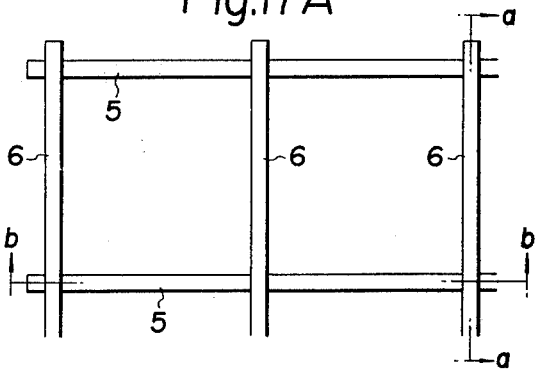
Figure 18A:
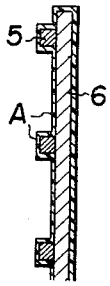
FIGS. 18A and 18B are cross sectional views of the net illustrated in FIG. 17A and 17B with the wires covered with an abrasion-resisting organic elastomer in accordance with the present invention.
Figure 18B:
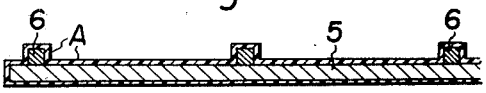

Whatever the configuration of the mesh openings, and whether wires, rods or bars, secured together at their crossing points in the manner hereinabove described, are utilized to define the mesh openings, the present invention contemplates that the external surfaces of the metallic wires or strands will be covered with an abrasion-resisting organic elastomer. Such covering may be accomplished either by using prefabricated cushions of abrasion-resisting organic elastomer in some configuration such as is illustrated in cross sections in FIGS. 6A through 6I, with the ends of such coverings fused together at each contact points; or, alternatively, the metallic wire net may be covered directly with such an elastomer. In this manner, the final metallic wire netting which is covered with the abrasion-resistant organic elastomer will appear either as shown in FIGS. 15A, 15B and 15C, or, if the strands are provided with square cross sections are shown, for example, in FIGS. 17A, 18A and 18B. Obviously, the strands 5 and 6 could have any other polygonal cross section.

When it is desired to apply some type of covering, such as any of those illustrated in FIGS. 6A through 6I, or others, to a metal bar or wire netting, a suitable groove B is provided in the covering A. Alternatively, a strand 5 or 6 could be inserted in the hollow core M of a cylindrical type covering A′ before or after the metal strand is welded to a crossing strand.

Figure 19B:
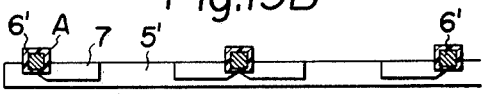
FIGS. 19B and 19C are cross sectional views taken on the lines a—a and b—b, respectively, of FIG. 19A and looking in the direction of the arrows.
Figure 19A:
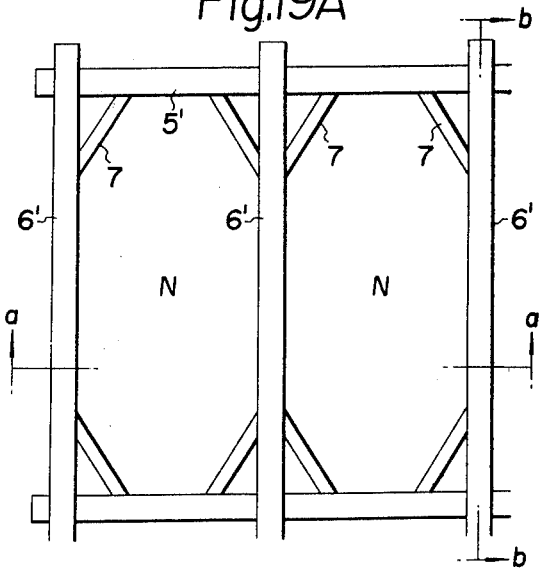
FIG. 19A is a plan view of another embodiment of the present invention.
Figure 19C:
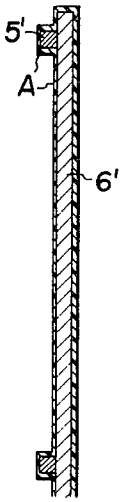

In the embodiment of the invention illustrated in FIGS. 19A, 19B and 19C, the configuration of the large rectangular mesh openings N may be modified by providing bridging strands 7 to extend across the corners formed by the intersections of the strands 5′ and 6′. The strands 7 may be metal wires, each of which may be covered with an abrasion-resisting organic elastomer in the manner described above with reference to FIGS.

15A, 15B, 15C and 18A and 18B. Thereby, the corners of the large mesh openings may be cut off at angles to restrict the size of particles or pebbles which can pass through the mesh openings N. Additionally, providing the bridging wires 7 may serve to improve the vibrating action upon the pebbles or particles, as well as to reinforce the net. This constitutes a special application of the present invention and should not be regarded as necessary for the practice thereof.

Figure 22A:
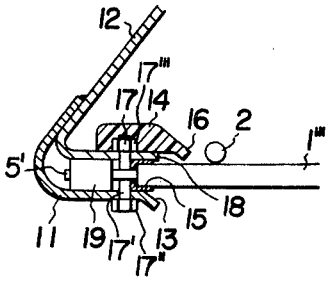
FIGS. 22A and 22B are cross sectional views illustrating means for mounting netting or screening in a sieve in accordance with the present invention.
Figure 22B:
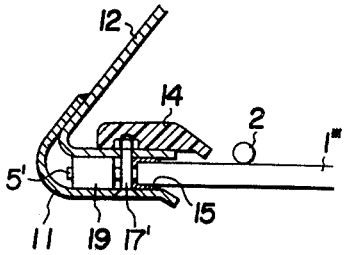

FIGS. 22A and 22B (and 23A, 23B and 23C) illustrate a different manner of securing the ends of the transverse strands to form screening than that which has been discussed above in connection with FIGS. 8 and 10. Thus, in the embodiment of FIGS. 22A and 22B, a strip 14 of an abrasion-resisting organic elastomer may be provided to cover the upper surface of an upper clamping plate 12. This covering strip 14 may have an edge 16 which extends inwardly toward the center of the screen and beyond the inner edge 18 of the upper clamping plate 12. Such a covering strip 14 serves not only to protect the upper clamping plate 12 and the metal fitting 17, but also to prevent the upper surface of the organic elastomer strand 1 from being brought into contact with, and damaged by the inwardly extending end 18 of the upper clamping plate 12. In addition, by providing an orificed abrasion-resisting elastomer channel 15 between the clamping plates 11 and 12, such channel 15 may serve to insulate the upper and lower surfaces of the covered strands 1 from being damaged or deformed when the two clamping plates 11 and 12 are tightened together by the fitting 17. It will also be noted that the inner edge of the clamping plate 12 may extend further toward the center of the screen than the downwardly curved edge 13 of the lower clamping plate 11, thereby more effectively to prevent shearing of the lower surface of the transverse strand.

After the organic elastomer covering has been removed from each end of the strand 1''' in the FIGS. 22A, 22B embodiment, thereby to expose the core 5', such core may be inserted through the orifice in a metal fitting similar to the solderless terminal or link fuse 19. Such fitting could also be a nut having inside screw threads. This fitting 19 with its inserted strand core end 5' may then be clamped between the upper metal clamping plate 12 and the lower metal clamping plate 11, both of which clamping plates may be drawn tightly together by means of the fitting 17. The latter may comprise an elongated fastener 17' having a head 17'' at one end and being threaded at the other end to receive a nut 17''' which may be tightened on such threaded end. When tightened by such devices as are shown in FIGS. 22A and 22B, the transverse strands 1''' should remain undamaged and not become loosened.

Figure 20:
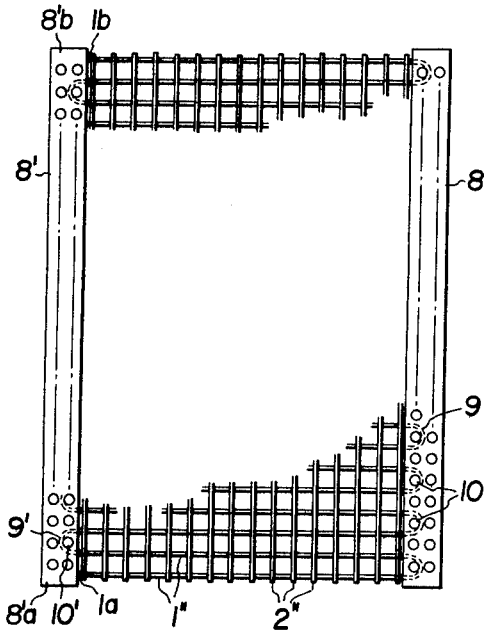
FIG. 20 is a plan view showing a sieve with an arrangement of transverse strands constituted of an endless strand in still another embodiment of the present invention.
Figure 21:
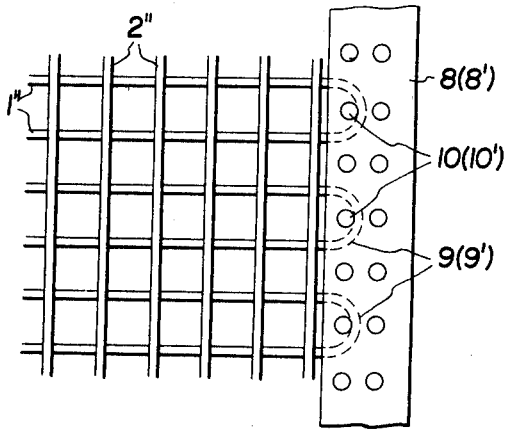
FIG. 21 is an enlarged view of a portion of the sieve shown in FIG. 20.

In the embodiment of the invention illustrated in FIGS. 20 and 21, the transverse strands 1'' comprise a single cored strand of an abrasion-resisting organic elastomer, one end 1*a* of which may be secured to the bottom 8*a*' of the side member 8'. The cored strand is then laced back and forth between, and looped over pins or projecting elements 10, 10' on the side members 8,8', respectively, with the other end 1*b* of the strand 1'' terminating at, and being secured to, the upper end of the side member 8*b*'. If the two side members 8,8' are pulled apart from each other, they will effect a tightening of the strand 1''. Longitudinal strands 2'' may then be placed over the thus laced strand 1'' with the crossing points being secured by fusing in the manner heretofore described. Alternatively, tightening of the strand 1'' in its laced pattern may be accomplished by the means shown in FIG. 10 with the shear providing strip 14 and channel 15, illustrated in FIGS. 22A and 22B and discussed in connection with those Figures, being additionally provided.

Figure 23C:
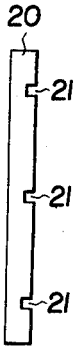
FIG. 23C in a plan view of the metal spacer shown in FIG. 23A.
Figure 23A:
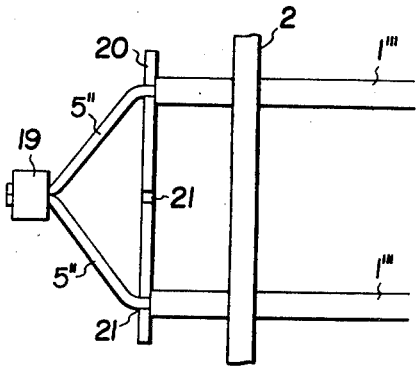
FIGS. 23A and 23B are plan views of other embodiments of the present invention, illustrating two means for mounting exposed strand cores comprising fine wires.
Figure 23B:
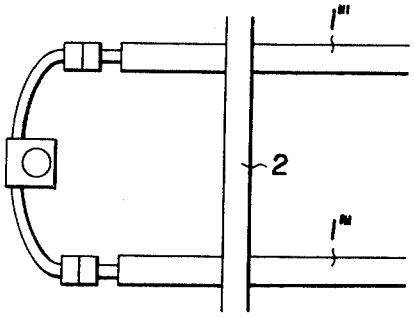

In the embodiment of the invention illustrated in FIG. 23A, the ends of the plurality of exposed cores 5'' of strands 1''' may be brought together and inserted into a metal clamping member 19 to be secured therein. Such core ends may be braised into the element 19. In addition, a metallic or other type of spacing member 20 may be provided with a series of spaced grooves 21. Such grooves may be equidistantly spaced from each other or spaced at any other desired interval or intervals. When the exposed cores 5'' are laid into the grooves 21 in the member 20, the desired spacing of the strands 1''' will be properly established and maintained.

Should it become desirable to prevent the wire cores of a net or screen from becoming separated from their organic elastomer coverings, after the transverse strands have been cut or otherwise formed to the required length and their organic elastomer coverings have been removed from the ends of such strands 1''' to leave the exposed cores 5'', as shown in FIG. 23A, the strands may then be sufficiently heated to cause the organic elastomer coverings to fuse onto the cores. It would also be possible, of course, to cause such fusing of the strand coverings on the cores even without first stripping the coverings from the ends of the cores as shown in FIG. 23A. Heating to cause such fusion could be provided by passing a sufficient electric current through the wire core to raise the temperature of the latter to somewhere between 250° to 300° for a brief period. At such temperature range, a covering of, for example, urethane, will begin to melt and thereby fuse to the core. It has been found that where coverings are fused throughout the entire lengths of the strands without exposing the cores at the ends of the strands, tension of the transverse strands may be better maintained in netting or screens of the type hereinabove described.

Now several embodiments of this invention will be described.

The surface portions at least of the strands of which the net is composed consists of an abrasion-resistant organic elastomer body. Where necessary, the so-called elastomer-covered core strands consisting of core strands having no elongation property and an abrasion-resistant organic elastomer body can be used in such a manner that no slack of the transverse strands may be produced.

As the core strands, not merely metallic wires such as piano wires, but also a fibre material such as nylon (Du Pont's tradename, polyamide system fibre), and daclon (also Du Pont's tradename, polyester system fibre) possessing a small elongation property can be used.

Carbon fibre strands reinforced with a resin material, such as polyester-, epoxi-, polyamide-, phenol-, or polyethylene-resin (called sometimes FRT, FRTP, and FRTS) and coated and adhered with a polyurethane, elastomer provide light and strong abrasion-resistant organic elastomer-covered core strands.

Although such carbon fibres are excellent in performance, the manufacturing cost is very expensive at present.

Table 1 shows an example of the glass-fibre core strands covered with an elastomer whose principal constituent is a polyurethane elastomer, together with the elastomer covering ratio and the space ratio.

TABLE 3

| A Diameter of Cored Elastomer Covered Strands | B Diameter of Glass Fibre Core Strands | A/B Elastomer Covering Ratio | C Mesh Opening mm | D Ratio of C (Mesh opening) to Core Strand Diameter | E Space Ratio % |
|---|---|---|---|---|---|
| | | Space Ratios of the Cored Strands according to this invention | | | |
| 1.2 ϕ | 0.8 ϕ | 1.5 | 3–4 | Approx. 3 | Approximately 60% maintained for each case. This is 1.5–20 times that of the knit nets. |
| 1.6 ϕ | 0.8 ϕ | 2.0 | 3–5 | Approx. 3 | |
| 2.0 ϕ | 1.2 ϕ | 1.7 | 4–7 | Approx. 3 | |
| 3.0 ϕ | 1.2 ϕ | 2.5 | 5–12 | Approx. 2–4 | |
| 4–6 ϕ | 2.0 ϕ | 2–3 | 10–30 | Approx. 2.5–5 | |
| 8–10 ϕ | 3.0 ϕ | 2.7–3.3 | 20–45 | Approx. 2.5–5 | |
| 12 ϕ | 5.0 ϕ | 2.4 | 30–150 | Approx. 2.5–10 | |
| 16 ϕ | 5.0 ϕ | 3.2 | 30–150 | Approx. 2–10 | |
| 20 ϕ | 10.0 ϕ | 2.0 | 100–200 | Approx. 5–10 | |
| 30 ϕ | 10.0 ϕ | 3.0 | 100–200 | Approx. 3–7 | |

A: finished strands diameter mm to be used net $$D = \frac{\text{Mesh opening mm}}{\text{Strands diameter having core mm}}$$

As indicated in Table 3, screening was carried out with the nets mesh openings of which ranged from 3 mm to 200 mm. In conducting this experiment the abrasion-resistant organic elastomer diameters ranged from 1.2~30 mm, the glass fibre core diameters from 0.8 to 10 mm, the diameters of the elastomer-covered strands ranged from 1.5~3.5 times the diameters of the core strands, and the space ratio of 60% was maintained.

The mesh opening ratios and space ratios of the nets according to the embodiments of this invention are listed in Table 3.

According to the embodiments of this invention, the four sides of each mesh opening constitute two different levels with the upper and lower layer strands, each having a circular cross-section, whereas according to the conventional knit nets, the four sides of each mesh opening are substantially in a plane. This very difference is the cause for permitting the space ratios according to this invention to be taken greater than those of the prior art nets. This difference plays an important role for the marked improvements in both screening and workability.

The thickness ratio of the elastomer covered strands used for the two layer strands was also investigated. Our test results with other embodiments of taking the elastomer thickness of the upper layer elastomer-covered strands one to five times that of the lower layer elastomer-covered strands have verified that the thicknesses of the order of one to three times provide a favorable effect. Since the upper layer strands have naturally a higher contact ratio with the object to be processed than the lower layer strands, a well-balanced durability life span for both layers can be expected from this order of thicknesses.

However, this ratio should be subject to change with the kind of object to be processed or the operating circumstances, etc.

With each of the embodiments using the glass-fibre core strands shown in Table 3, the ratio of the diameter of the core strands to the diameter of the elastomer-covered strands was investigated.

It was discovered that the optimum ratios of the diameter of the glass fibre core ranged between 1.5 to 3.5. The optimum ratios where the elastomer strand diameters are small and the mesh openings are fine should preferably be between 1.5 and 20. This ratio should be subject to variation with the kind of object to be processed or the operating conditions, the optimal value ranging between 1.3 to 3.5.

In conducting the tests of all embodiments shown in Table 3, which maintained the space ratio of 60%, the average side dimension of the square or rectangular mesh openings varied from 2 to 10 times the average diameter of the strands or wires. The mesh openings should preferably be of the dimensions equal to 2~7 times the diameter of the organic elastomer-covered strands of which the net is composed. The recommendable ratio for the fine mesh openings should be from 2 to 4, while that for the large mesh openings of 100 mm or above should be from 3 to 7. Of course, these ratios must be suitably adjusted depending on the object to be processed or the operating conditions.

Then, see Table 2A and 2B, weights of a few kinds of nets were investigated as an important reference problem. The weight of the net with 100 mm mesh openings made of conventional steel wires SWRH42A (conforming to the JIS Standard, JIS-G 3506-1971, C 0.39~0.46%, Si 0.15~0.35%, Mn 0.3~0.6%, both P and S—less than 0.04%) was 13 kg/m$^2$. The weight of a perforated plate with 100 mm square punched holes, 6 mm thick, made of a stainless steel material was 20 kg/m$^2$.

In contrast, the weight of the net with 100 mm mesh openings constituted of the glass fibre core strands covered with an abrasive-resistant organic elastomer having an overall diameter of 10 mm was 4 kg/m$^2$. This corresponds to only 30% of the weight of the steel wire net and 20% of that of the stainless steel perforated plate.

This feature of lightweight offers marked advantages in transportation, administration, storage, repair, and installation, as well as in workability. The feature also displays the outstanding improvements in increasing its durable life span and in reducing the power costs.

With the conventional screen nets such as steel nets, increasing the mesh opening ratios was invariably accompanied by the defect of deteriorating the durability and shortening the serviceable life. This problem has been solved by this invention as has been described by reference to the embodiments indicated in Table 4A, 4B.

Trommels or sieves have been used for screening lime stone, ore, crushed stones for mixing concrete.

Presented below are our investigation results for several embodiments of nets for use with concrete mixing trommels having diameters of 900~1500 mm and lengths of 3,000~10,000 mm.

The description will be limited to the trommel net dimensions of a cylindrical form having the diameter of 1,000 mm, the length of 7,000 mm, and the area of 22 $m^2$.

TABLE 4A

| A Diameter of Elastomer Strands mmϕ | Practical Measured Space Ratio to Strands Diameter: B Mesh Opening mm | C Steel Net Opening Ratio % | D Rubber Net Opening Ratio % | E Net of this Invention, Opening Ratio % |
|---|---|---|---|---|
| 3 | 10 | 59 | 48 | 59 |
| 4 | 15 | 62 | 43 | 62 |
| 6 | 25 | 65 | 48 | 65 |
| 8 | 30 | 64 | 45 | 64 |
| 8 | 35 | 66 | 44 | 66 |
| 10 | 40 | 64 | 53 | 64 |
| 10 | 45 | 53 | 53 | 67 |

TABLE 4B

| A Diameter of Elastomer Strands mm | B Mesh Opening mm | Practical Weight of Net or Instead Material: C Weight of Steel Net kg/$m^2$ | D Weight of Rubber Net kg/$m^2$ | E Weight of Net of this invention kg/$m^2$ |
|---|---|---|---|---|
| 2 | 6 | 6.7 | 13.1 | 2.4 |
| 3 | 10 | 10.0 | 22.2 | 3.4 |
| 4 | 15 | 13.0 | 25.0 | 4.3 |
| 5 | 20 | 13.4 | 25.5 | 4.5 |
| 6 | 25 | 15.8 | 30.1 | 5.3 |
| 8 | 30 | 20.6 | 32.1 | 6.9 |

$$\text{Space Ratio} = \frac{\text{Area of mesh opening } (m^2)}{\text{Area of 4 centre of strands diameter around mesh opening } (m^2)} \times 100$$

Now the weights of various nets having the area and the specified values in Table 4B will be compared.

The total weight of the net constituted of the strands of the SWRH42A material, 10 mm in the strand diameter, and 100 mm in mesh openings was 286 kg and that of the net using the stainless perforated sheet was 440 kg.

In contrast, the net according to this invention weighed only 83 kg.

Trommels using the nets according to this invention are advantageous in operation over those using the conventional nets in the following respects: (1) reduction in the power cost, (2) installation costs of power transmission, distribution, and substation facilities. The administration and maintenance costs can also be greatly reduced. (3) transportation and storage costs become inexpensive.

The net according to this invention, when broken down into several parts, can be transported by a light track instead a heavy track as used for carrying the broken-down parts of a conventional net.

For installation or replacement work, it will be obvious that the net according to this invention is advantageous over any other conventional nets.

Some tests were examined on other practice of the undermention, in the case of useness to Oscillating sieve.

The present invention conducted a test for demonstrating blocking and workability of the nets according to the embodiments of this invention. Our investigation results for attesting the limiting conditions for the occurrence of blocking is tabulated below, in connection with Oscillating Screen to sieve.

TABLE 5

| | Blocking & Life (Usable Span) to Oscillating Screen to Sieve: Conventional Steel Nets (1) | (2) | (3) | Rubber Net | Net of the Invention |
|---|---|---|---|---|---|
| Diameter of Strands (mm) | 1.2 | 1.2 | 5.0 | 13.0 (thickness | 5.0 |
| Mesh Opening (mm) | 3.0 | 3.0 | 15.0 | 15.0 | 15.0 |
| Rotation Speed (r.p.m.) | 1,000 | 800 | 800 | 1,000–1,100 | 500 |
| Vibration Amplitude (mm) | 10.0 | 5.0 | 10–15 | 10–12 | 5 |
| Blocking Status | Net unusable blocking | Net blocked | Net blocked montly | Net blocked | No blocking at all |
| Usable Period (months) | 3–5 | 3–5 | 3–5 | 3–5 | >20 |

As will be obvious from the test data, the net according to this invention offers markedly easy working conditions, small rotation speed and vibration amplitude, reduced power cost and requires only small scale power facilities.

Further, the net according to this invention has proven to have outstanding features over the conventional nets, such as, lightweight, larger opening ratios, longer durable life spans of the order of 5 to 7 times those of the conventional nets.

Operation of the net according to this test was stopped after it had been operated for 20 consecutive months. It was discovered, however, that the net was still repairable, maintained the same performance as at the time of installation.

Another important advantage of the use of the net according to this invention is the possibility of prevention of public hazard due to sound waves. According to our survey, the audible noise heard by normal persons from operation of the net according to this invention decreased markedly and notably, the production of inaudible or low-frequency sound waves of frequencies less than 20 Hz also decreased.

When one considers that low-frequency sound waves are hazardous to the human body, one can easily imagine that the use of the net according to this invention serves greatly for the prevention of environmental hazards.

There are a few theories which are conceivable for clarifying the causes for the less occurrence of low-frequency sound waves from the net according to this invention—the air vibration theory, the metallic wire vibration theory, and the resonance theory. The measurement method for such hazardous low-frequency sound waves has not yet been established.

It has been verified by our experiment that use of the net according to this invention constituted of abrasion-resistant organic elastomer covered strands consisting of the glass fibre wire strands and a polyurethane elastomer plays a dominant role in reducing the production of hazardous low-frequency noise.

It will be appreciated by persons skilled in the art that the present invention, as described in connection with the several embodiments hereinabove described with reference to the accompanying drawings, will produce a greatly improved screen for use in ore-type sieves. Advantage is taken of the elasticity, strength, abrasion resistance and the inherent surface smoothness and thermo-plasticity or thermo-setting ability, of the abrasion-resisting organic elastomer strands or portions of the strands. With sieves constructed of strands in the manner hereinabove disclosed, the movement of pebbles or other particles to be sifted is greatly facilitated so as to produce a significant improvement in the efficiency of the sifting process. Moreover, such sieves will be lighter in weight than prior art sieves; they can be made smaller; and because of the flexibility of the strands, the sieve screens may even be foldable to facilitate storage and transportation. Since the exposed portions of the strands are abrasion-resisting organic elastomers, the sieve screening will not rust so that it will have a much longer life than prior art screens. In addition, screening so constructed may be more easily repaired and installed and such screening lends itself to mass production. In addition, the sifting noise will be found to be significantly reduced. More importantly, however, sieves constructed of strands in accordance with the present invention as hereinabove disclosed, will be found to be much more accurate in sifting out particular sized particles and, because of the resiliency of the strands of their coverings, clogging of the screen will largely be avoided.

The present invention will be found to be applicable to many different types of net or screens, such as those having very fine mesh openings or very large openings, openings of different size rectangles, or of other polygonal openings. The present invention, therefore, will be found to be extremely useful in many fields and methods of utilization.

I claim:

1. An apparatus for screening including a preselectable, tensionable resilient screen to be used in a vibrating sieve, said screen comprising:

a first layer of tensionable transverse strands being laid in a plane, each of said transverse strands comprising of an elongated element having at least its outer surface constituted of an abrasion-resisting organic elastomer, said strands being laid parallel to each other and spaced by a first preselectable interval distance from each other;

a second of layer of tensionable longitudinal strands being laid upon said first layer of said transverse strands so as to be in a plane and forming mesh openings, said second layer of strands being constituted of longitudinal strands having at least their outer surfaces covered with a layer of abrasion-resisting organic elastomer, said secod layer being fused to said first layer at crossing points by heating said first and second layers to produce a predetermined amount of melting whereby a resilient screen having mesh openings of a preselectable size is provided; and a plurality of bridging strands extending across all corners of said mesh openings from said first strands to said second strands, said bridging strands comprising a elongated element having at least its outer surface constituted of an abrasion resisting organic elastomer.

* * * * *